United States Patent [19]

Right et al.

[11] Patent Number: 4,506,254

[45] Date of Patent: Mar. 19, 1985

[54] ALARM SYSTEM WITH DETECTORS AND SIGNALING DEVICES ON THE SAME CABLE PAIR

[75] Inventors: Robert W. Right, Huntington; Irving Mande, Westport, both of Conn.

[73] Assignee: General Signal Corporation, Stamford, Conn.

[21] Appl. No.: 440,643

[22] Filed: Nov. 10, 1982

[51] Int. Cl.[3] ..... G08B 29/00

[52] U.S. Cl. ..... 340/510; 340/506; 340/511; 340/513

[58] Field of Search ..... 340/510, 511, 512, 513, 340/506, 507–509, 531, 635, 650, 651, 652, 653, 661, 662, 663, 664

[56] References Cited

U.S. PATENT DOCUMENTS

| | | | |
|---|---|---|---|
| 3,500,394 | 3/1970 | Egesdal | 340/513 |
| 3,678,509 | 7/1972 | Carlo et al. | 340/511 |
| 3,936,821 | 2/1976 | Cooper et al. | 340/510 |
| 4,060,803 | 11/1977 | Ashworth, Jr. | 340/506 |

*Primary Examiner*—Donnie L. Crosland

*Attorney, Agent, or Firm*—Ronald Reichman; Milton E. Kleinman; George W. Killian

[57] ABSTRACT

A single zone system which may use a single cable pair for both detectors of nonstandard conditions and audio/visual alarms. The audio/visual alarms are polarity responsive and in response to an alarm detection, comprising an increase in line current, the polarity is reversed and the line current supervision circuit disconnected. Some detectors or signaling devices may be polarity sensitive so that they present a high impedance under normal and reverse polarity conditions, and a lower impedance on abnormal conditions and prior to polarity reversal. Other detectors may be polarity insensitive and include a relay which may be activated from line potential subsequent to detection of an abnormal condition. The relay may be used to operate door closers or to initiate other appropriate action. A feature of the invention is that a nearly unlimited number of the polarity insensitive detectors may be used because the line current supervision circuit is removed and a hard power supply connected to the line after the first alarm is received.

11 Claims, 3 Drawing Figures

ALARM SYSTEM WITH DETECTORS AND SIGNALING DEVICES ON THE SAME CABLE PAIR

FIELD OF THE INVENTION

Alarm systems for indicating and responding to any of a wide variety of nonstandard conditions are widely and extensively used in a variety of locations and to indicate a variety of nonstandard conditions. In response to the detection of the nonstandard condition, various responses may be desirable. These may include: sounding an alarm, turning off or on an associated device, signaling a remote site, closing doors, shutting down heating and ventilating systems, and any of a wide variety of other actions which may promote the general safety and welfare of life and property. The invention to be described herein may be used in a wide variety of circumstances, conditions and locations. The system will be found to be applicable to installations requiring one or more devices for detecting a nonstandard condition and wherein, in response to such detection, audible and/or visual alarms and/or the control of auxiliary equipment may be desirable.

Systems of the general type described might find utility, for example, in a household, apartment, small business, or other location where it is desirable to have detectors which respond to abnormal conditions including fire or smoke detection, temperature or moisture conditions outside desired limits and/or any of a wide variety of other conditions requiring attention. The system may also be incorporated into a multizone system.

DESCRIPTION OF THE PRIOR ART

Systems providing the general features set forth hereinabove are well known and widely used as exemplified by the wide variety of fire, smoke and/or burglar alarm systems frequently provided in the types of locations mentioned. The detector devices, in one type of prior art system, may be connected in a closed loop which is opened in response to any of the abnormal conditions. In response to the detection of the open loop, various alarm signals which may comprise audible/visual signals may be actuated. In other types of systems, the detecting devices are normally open, or high impedance devices bridged across a cable pair. In response to the detection of an abnormal condition, the detectors close, or switch to a lower impedance condition, which is detected by a supervisory circuit at a control center and in response to such detection appropriate visual/audible signals may be activated and/or other action may take place either automatically or under the control of an attendant.

In both of these systems, it will be seen that one loop, or a cable pair, is used for the detectors and that separate wiring is required for the audible/visual signals and/or other controls.

U.S. Pat. No. 3,661,362 issued to Robert D. Scott on Oct. 5, 1971 describes an alarm sensing and indicating system wherein both the detectors and the alarm devices may be bridged across a single cable pair. The system uses low energy of one polarity for supervision and is energized at a higher level with a reverse polarity in response to the sensing of an alarm condition. The Scott circuit functions admirably but has a shortcoming in installations wherein the detectors may include auxiliary relays which may be used to control other devices to enhance the protection of life and property. That is, in the Scott system, the first detector to sense a nonstandard condition will cause a line polarity reversal and thereby disconnect, or render insensitive all remaining detector units. It will be apparent that in some types of installations and circumstances, it would be desirable to have at least some of the plurality of detectors be able to respond to the changing conditions of the situation and, when and if appropriate, close passageways, ventilating systems, shut down heating plants and/or initiate any other action which may promote the welfare and safety of personnel and property. The Scott system is also limited to systems wherein the only line current prior to activation of a detector is the current which results from the end-of-line resistor.

U.S. Pat. No. 3,569,964 issued Mar. 9, 1971 to Irving Mande describes a supervisory alarm system which also provides a reverse polarity on the supervised cable pair under selected conditions. More specifically, the Mande patent teaches a supervision circuit including a typical end-of-line resistor which has extended stand-by service in the event of a commercial power failure by reversing the line polarity to increase the end of line resistor, since it is in series with a diode, and thereby greatly reduce the power drain from the stand-by batteries.

While the Scott and Mande patents both teach line polarity reversal, their function and inventive features have little in common.

SUMMARY OF THE INVENTION

The present invention provides an economical, efficient and convenient system which provides for bridging all detectors, audible/visual alarms, manual pull stations, smoke or heat detectors, and control relays across a single cable pair terminated with an end-of-line resistor. Conventional loop supervision is provided using the end-of-line resistor. Some detectors may draw current under normal conditions and therefore, the central station must be able to distinguish between: an open loop; a loop with and without the end-of-line resistor and an increased current due to an activated detector. In response to an increased loop current resulting from the activation of any one of the variety of detectors or alarm sending devices, the polarity of the cable pair is reversed, the line supervision circuit removed and the line connected to a higher energy supply. The various audible/visual alarm devices are polarized and activated only in response to polarity reversal of the line. In addition, polarized relays may be bridged across the line for controlling any apparatus which should be controlled in a predetermined manner in response to any alarm condition. This could include, shutting down heating and ventilating systems, closing doors or passageways, terminating elevator operation or any of a variety of other actions which will promote the safety and welfare of property and personnel. A feature of the invention is that non-polarized detectors may be provided so that they may continue to monitor the area proximate to them and respond to the abnormal condition for which they were designed. Typically, such non-polarized detectors draw some current in the standby condition and may include an auxiliary relay and therefore, since the devices are non-polarized, the auxiliary relay may be actuated from line potential in response to activation of the detector. Accordingly, if the non-standard condition is expanding to new areas and endangering new portions of the protected zone, appropriate action may be taken in each such area in response to the detection of the abnormal condition. Although audible/visual alarms may be included on the cable pair with the detectors, it should be understood that, if it is expedient, an additional alarm pair may be used.

It is an object of the invention to provide a new and improved detection and alarm system which may incorporate detectors, signaling devices and alarms on the same cable pair.

It is a more specific object of the invention to provide an alarm system of the type described and having a polarized alarm device which responds to a polarity reversal of the line.

It is another object of the invention to provide a system of the character described which may include detectors and/or alarm signaling which are polarized and inactivated in response to polarity reversal of the line.

It is a particular object of the invention to provide a non-polarized detector which may include an auxiliary relay such that the non-polarized detector may respond to nonstandard conditions before or after an initial alarm and actuate an associated relay for providing additional control.

It is another object of the invention to function with detectors which draw some standby current.

It is another object of the invention to provide a system which may have a virtually unlimited number of polarity insensitive detecting devices.

It is another object of the invention to supervise the integrity of the cable pair across which the various devices are bridged and to provide an alarm in the event the current in the cable pair drops below a predetermined value.

It is another object of the invention to disconnect the line current supervision circuit concomitantly with line potential reversal whereby a hard power supply is connected to the line.

It is another object of the invention to provide a system which couples a predetermined potential to the cable air in response to line reversal resulting from actuation of a detector or signaling device.

BRIEF DESCRIPTION OF THE DRAWING

The drawing comprises three figures which, when arranged side by side and in numeric order, comprises a circuit diagram of typical components which may be employed in the system. The circuit diagram employs conventional symbols for the various components. In order to further facilitate purusal and understanding of the invention, a system of designation has been employed which will aid in identifying both the character and location of the element. More specifically, when the element constitutes an lectrical device, the first character of the designation will comprise a letter indicative of the nature of the device. For example, when the first letter of the designation is D, R or T, the designated element is a diode, resistor or transistor, respectively. In like manner, relays are given K designators. Identifiers without an initial alpha character, indicate other elements such as terminals, junctions, individual wires or other elements and devices. The first numeric element of a designator will give some indication of the location of the element. More specifically, first digits of 1, 2 or 3 will indicate that the element is located in FIGS. 1, 2 or 3, respectively. Numbers following the initial digit are for further distinguishing one element from another.

The interconnections between the figures are evident when the figures are positioned in numeric order from left to right.

DESCRIPTION OF THE PREFERRED EMBODIMENT

Depending upon a variety of conditions including the area and/or number of rooms and/or floors within an area to be protected, the system may comprise one or more zones of protection. The description to follow will deal with a single zone only, but it should be understood that the principles and concepts may be employed in a multi-zone system. The system is described primarily in terms of fire and smoke detection and appropriate alarming in response to detection thereof. However, it should be understood that the system is equally applicable to systems required to detect and respond to a wide variety of other types of nonstandard conditions. These conditions may include: nonstandard temperatures, power failures, device failures, presence of personnel in unauthorized area, open passageways, and/or any of a wide variety of other conditions or circumstances which may be detected and cause the opening or closing of an electric circuit.

In typical alarm systems, there is a central station or central control point from which wires to each of the protected zones is extended. In some situations, the central control station may be at a remote site and may be attended. The systems are generally designed to provide alarm signals at both the central station and within the zone of protection.

Figure 1:
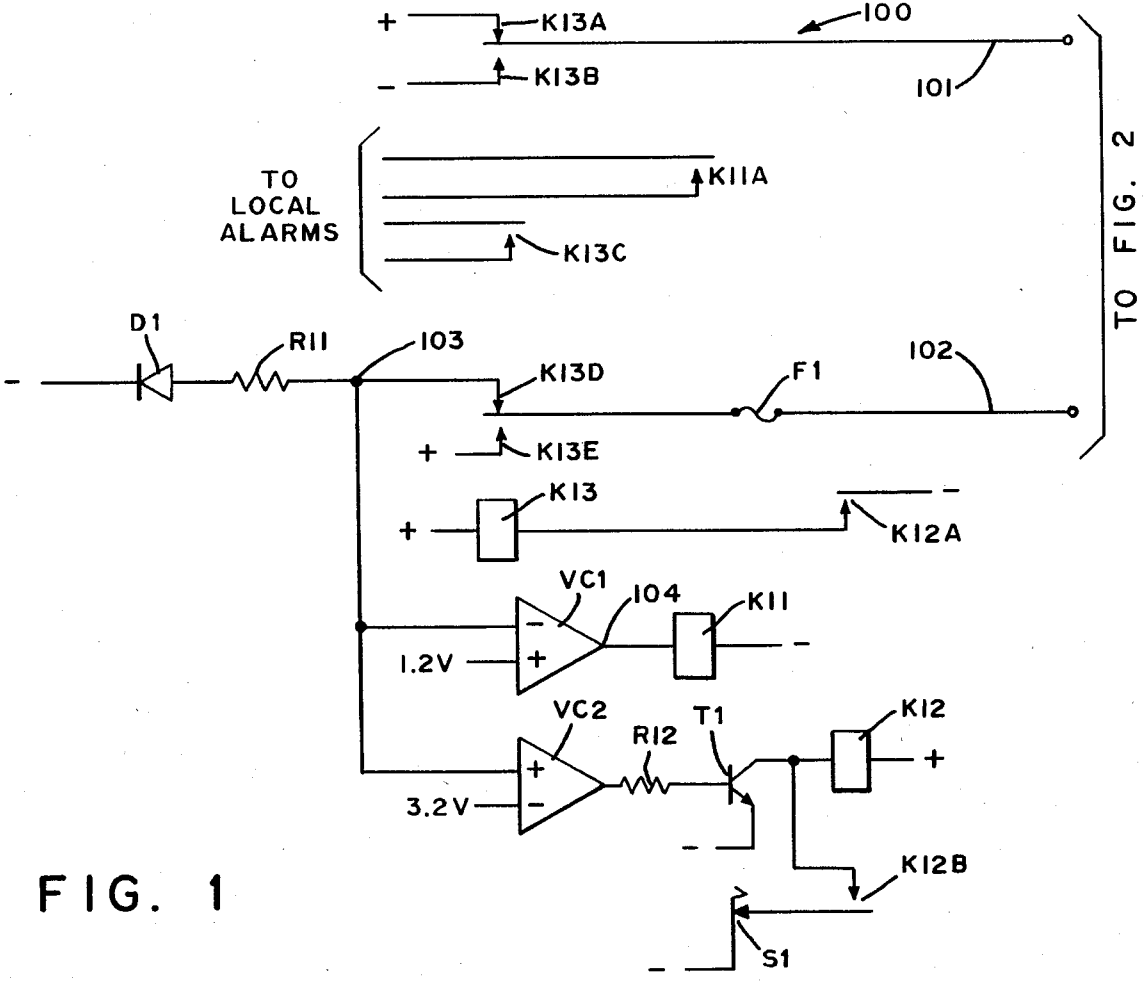
FIG. 1 comprises typical apparatus used at the control center.
Figure 2:
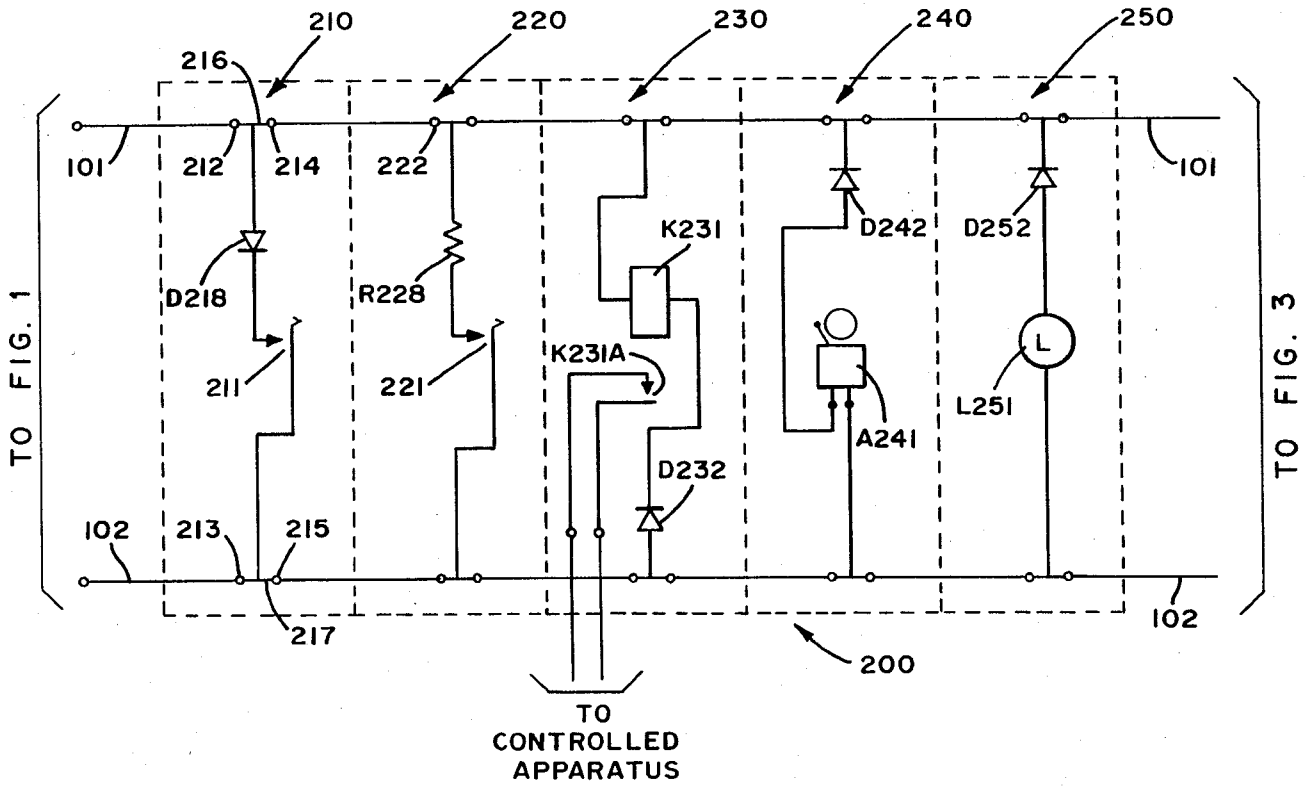
FIGS. 2 and 3 illustrate typical components which may be bridged across the cable pair extending to and through the protected zone.
Figure 3:
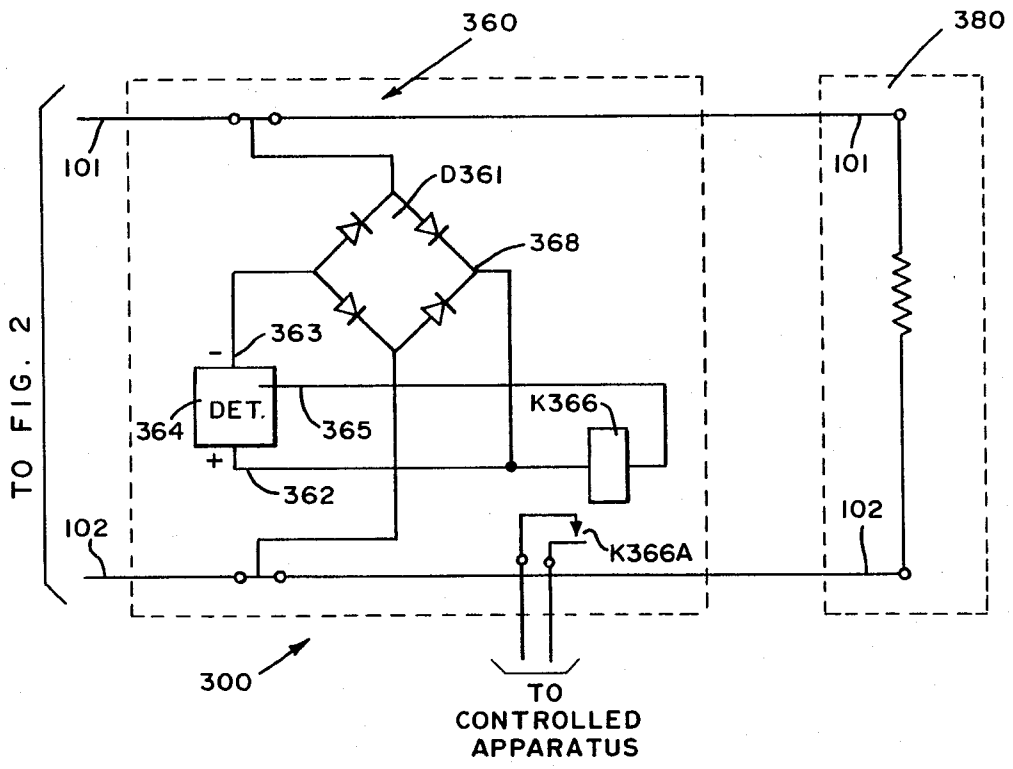

In the drawing, FIG. 1 comprises the basic and essential equipment provided at a control station and FIGS. 2 and 3 indicate typical equipment which might be used in the protected zone. Conventional symbols have been used and will be more fully explained in the description presented hereinbelow.

The circuit of the system may be most conveniently and expeditiously reviewed and analyzed by arranging FIGS. 1, 2 and 3 in numeric order from left to right. FIG. 1 comprises a central station indicated generally as 100. Extending from the central station 100 is a cable pair comprising individual wires 101 and 102. As may be seen, these wires 101 and 102 extend from FIG. 1 through FIG. 2 and to FIG. 3. FIGS. 2 and 3 represent the supervised zone designated generally as 200 and 300.

At the central station 100, there will be seen a plurality of + symbols which indicate a connection to the positive terminal of a DC power supply. It should be understood that all wires terminating with a + symbol are connected together and connected to the positive terminal of a DC power supply not otherwise shown. In like manner, the points designated with a − symbol constitutes a connection to the negative terminal of the DC power supply. Depending upon local codes and/or other considerations, one or the other, or neither, of the positive or negative terminals of the DC power supply may be connected to an earth ground. In like manner, one of the terminals may comprise a system or chassis ground. For equipment of this type, the negative is usually the one which is grounded.

The central station will be seen to include three relays, K11, K12 and K13. The operating coil of the relays is indicated as a rectangle and all contacts associated with the respective relays are located in vertical alignment with the coil. In accordance with one convention for illustrating relay contacts, they are drawn in their normal condition with the relay deenergized and further, the convention followed is that the straight line portion of the contact is considered as the moving swinger, or armature, and that it moves towards the rectangle representing the relay coil in response to energization of the relay. The contact pairs of each relay are designated to match the associated relay and an alphabetic suffix is used to distinguish one contact from another.

The central station 100 also includes two voltage comparators VC1 and VC2; a transistor T1, a diode D1, resistors R11 and R12 and a manually actuated switch S1 with normally closed contacts.

FIG. 2 illustrates some of the typical components which may be bridged across the cable pair 101 and 102 within the supervised zone 200. This equipment may include alarm sensing or manual singaling devices as illustrated generally at 210 and 220. There may also be a control device 230, an audible alarm 240 or a visual alarm 250. In addition, as seen in FIG. 3, there may be bridged across the cable pair 101 and 102 a smoke detector, or some other form of detector or signaling apparatus, having similar electrical characteristics and which is designated 360. In addition, there is an end-of-line resistor network 380 which is bridged across the remote end of the cable pair 101 and 102.

Returning now to FIG. 1, it will be seen that under normal conditions with relay K13 released, a positive potential is applied through relay contacts K13A to line 101 and that this positive potential may be applied to each of the devices 210, 220, 230, 240, 250, 360 and 380. In like manner, a negative potential is applied through diode D1 and current limiting resistor R1 through relay contacts K13D and the fuse F1 to the line 102 of the cable pair. This negative potential is applied to each of the devices enumerated hereinabove. No current will flow through the devices 210 or 220 because they are open circuited by their contacts 211 and 221, respectively. No current passes through relay K231 because diode D232 is reverse biased. In like manner, no current passes through the audible alarm device A241 because of the reverse connection of diode D242. In like manner, the visual indicator L251 is not illuminated because of the reverse connection of diode D252.

The detector 360 may be seen to include a diode bridge D361 and therefore, irrespective of the polarity of the potential on the cable pair 101 and 102 a positive potential may be applied to the lower terminal 362 and a negative potential applied to the upper terminal 363 of the detector 364. As suggested, the detector 364 may comprise a smoke detector. However, it should be understood that it may comprise any other type of detector or device that is suitable for detecting the desired nonstandard condition and which will close a pair of contacts to connect terminal 363 to lead 365. It will be seen that the detector 360, because of the diode bridge 361 will be operative irrespective of the polarity applied to the cable pair 101 and 102. Typical smoke detectors 360 draw a standby current of the order of 50 microamperes.

Considering now the end-of-line resistor 380, it will be seen that it comprises a simple resistor coupled across the remote end of cable pair 101 and 102. The arrangement of the installation is such that the end-of-line resistor 380 is at the end of the cable pair 101 and 102 which is most remote from the control station 100.

Systems of the type being described may be of critical importance in protecting life and property in the event of the occurrence of any of the nonstandard conditions which are monitored by the various devices bridged across the cable pair. Accordingly, it is necessary to supervise or monitor the integrity, by which is meant the continuity, of the cable pair 101 and 102. The end-of-line resistor 380 provides this function. So long as the supervised cable pair has continuity or integrity, a current will flow in the line. The line current may comprise two components: that attributable to the end-of-line resistor and that attributable to the sum of the standby currents of the smoke detectors 360. Subsequently, it will be shown that the interruption of this normal current will initiate a trouble signal. The capability of the system to respond to, and report, abnormal conditions will depend upon the physical presence of the various devices 210, 220, etc. Accordingly, and in accordance with a standard wiring technique, each of these devices has an "in" and "out" terminal for each of the lines 101 and 102. More specifically, the wire 101 from the central station is connected to the alarm device 210 at "in" terminal 212. In like manner, the line 102 is connected to "in" terminal 213. The alarm device 210 also includes "out" terminals 214 and 215 and these are connected by wire to the "in" terminals of the next device. The alarm device 210 is a physical piece of equipment comprising the "in" and "out" terminals 212 through 215 and the other components illustrated. The pair of "in" terminals 212 and 214 are typically screw terminals mounted on a conducting member 216 and in a like manner, the "out" terminals 213 and 215 are screws connected on a conducting member 217. Accordingly, if the device 210 is tampered with or removed, there will no be electrical continuity from the wire 101 connecting to the "in" terminal 214 through the device 210 and to the "in" terminal 222 of device 220. Each of the devices are connected in the manner described with respect to device 210 and therefore, if any of these devices is removed from its position, the integrity of the cable pair 101 and 102 will be destroyed. There will be no current in the end-of-line resistor 280 and this condition will be detected at the central station. This technique for supervising line integrity is standard and well known in the art and is described herein only to acquaint the novice with the need for the plurality of terminals on each of the devices 210, 220, etc.

As previously explained under normal conditions, there is a normal flow of current from the positive side of the line 101 through the end-of-line resistor 380 and the parallel combination of all the smoke detectors 360, to the negative side of the line 102 through the fuse F1 and normally closed relay contacts K13D through current limiting resistor R11 and diode D1 to the negative terminal of the power supply. The values of resistors R11 and R380 together with the loop resistance of the wires 101 and 102 is selected so that the terminal 103 which couples to the negative input terminal of the voltage comparator VC1 is such that as long as the cable pair 101 and 102 has continuity, the voltage comparator VC1 will maintain a negative output at terminal 104. It should also be understood that each of the devices 360 may introduce a very small standby line current and that the maximum value of this accumulated current must be considered together with the factors already mentioned. The maximum number of smoke detectors 360 which may be used is controlled by the various factors cited and specifically by the ability of the voltage comparator VC1 to distinguish between the various potentials at point 103 caused by the system under all possible conditions of temperature, voltage range, connected devices 360, and/or other factors. With the negative output at terminal 104, the relay K11 will be maintained inoperated. However, if anything should happen to the continuity of the cable pair 101 and 102, the current described will be interrupted or reduced and the terminal 103 will assume nearly full negative potential and the voltage comparator VC1 will place a positive potential at terminal 104 and thereby actuate relay K11. As soon as relay K11 is actuated, it will close contacts K11A which may be used to operate any type of local trouble signal and/or to transmit a trouble signal to a remote site. The loss of integrity of the cable pair 101 and 102 does not necessarily constitute a hazzard to personnel and property within the protected zone. However, it does indicate that the capability for detecting nonstandard conditions in the protected zone, and for providing appropriate controls and audio and/or visual alarms, is impaired. It should be noted that it is stated that the capability of the system is impaired and not that the system is inoperative. For example, if the integrity of the line was lost because the end-of-line resistor 380 had become disconnected, it would still be possible for the central station to respond to any of the detectors or signaling devices and for the central station to reverse the line potential to actuate the various alarms and/or control devices.

Let it now be assumed that through some sort of tampering or accident, the cable pair 101 and 102 was shorted together. This would reduce the loop resistance as the end-of-line resistor 380 would be shunted and there would be a material increase of the current through resistor R11. The increase in current through resistor R11 will make the potential at terminal 103 more positive and this will activate voltage comparator VC2 which will turn transistor T1 on and cause relay K12 to operate. Operation of K12 will cause it to lock itself in through its contacts K12B and the manually actuated release switch S1. Contacts K12A of relay K12 will actuate relay K13 and its contacts K13B and K13E will actuate to reverse the polarity of the potential applied to the cable pair 101 and 102. As previously suggested, the reversal of polarity on the cable pair will actuate the audible/visual alarms. More will be said about this hereinafter. The opening of contacts K13D removes the line current supervision circuit comprising diode D1, resistor R1 and the voltage comparators VC1 and VC2.

Returning now to alarm detector or signaling device 210, it will be seen that it comprises a pair of contacts 211 which may be closed to complete a circuit from line 101 through diode D218 and the contact 211 to the line 102. This will have the same result as the aforementioned short circuit across the line 101 and 102 and thus in response to the closing of the contacts 211, there will be a polarity reversal of the potential applied to the lines 101 and 102. As soon as the polarity of the lines 101 and 102 is reversed, there will be no further current through the contacts 211 because of the diode D218.

Considering now the similarities and differences of a short circuit across the lines 101 and 102 and an operation of the device 210, it will be seen that after line polarity reversal substantially no current flows as a result of the closure of contact 211 whereas if there was a short circuit on the line, a large current would continue to flow and depending upon the impedance of the short, the line length, the rating of fuse F1 and the DC potential, the fuse F1 might blow. In either event, the relays K12 and K13 remain operated and an alarm is provided at the central station.

Considering now the alarm detector or signaling device 220, it will be seen that it is very similar to the device 210 except that it uses a resistor R228 where the device 210 used a diode D218. The resistor R228 is chosen to have a value such that when the contacts 221 are closed the voltage comparator VC2 will detect the change in potential at terminal 103 and cause the operation of relay K11. However, the resistor R228 is of sufficient value that it does not contribute significantly to the line current subsequent to polarity reversal. The device 220 has the disadvantage, with respect to device 210, that it does draw line current during the reverse polarity alarm condition. However, it has the advantage that it may be coupled to the line without any consideration for polarity. That is, if the device 210 was coupled across the line 101 and 102 improperly, it would fail to turn in an alarm when actuated and if it was actuated after some other device had turned in an alarm, an improperly polarized device 210 could destroy the operability of the system at a critical time by blowing the fuse F1 or shunting and releasing devices 230 or 360. Careful installation and test procedures should guard against these problems.

With the polarity of the line 101 and 102 reversed so that they have a negative and positive potential, respectively, it will be seen that the alarm A241 and the lamp L251 will be activated to provide audible and visual alarms within the protected zones 200 and 300. Naturally, there may be a plurality of any one of the devices 210, 220, 230, etc. When the polarity is reversed, the current limiting resistor R11 is disconnected and the power available on the cable pair is limited only by the capacity of the power supply and fuse F1.

It will also be seen that in response to the polarity reversal on the line, the relay K231 will be operated and that its contacts K231A will be closed and may be used to operate auxiliary equipment to control any apparatus which it may be expedient to control. For example, if the system is a security system and an alarm has been received indicating the presence of unauthorized personnel, the K231A contacts of relay K231 may be employed to initiate the closure and locking of room and/or corridor doors. The contacts might also be used to shut down a ventilating system to prevent the spread of noxious gases to other floors and/or to terminate or initiate any other action which is desirable in view of the conditions.

It will be understood that plural devices 210 or 220 may be bridged across the line and the actuation of any one of these subsequent to the actuation of an initial one will have no further useful effect. That is, such additional operation of detectors will not change the alarm conditions or control any other equipment. This will be perceived as a major disadvantage of the system as thus far described. That is, the protected zone may comprise a plurality of rooms and depending upon their use and location with respect to the originating alarm detecting device, it may or may not be desirable to close certain doors and/or activate other controls. It is to overcome this difficulty that detectors of the character indicated at 360 are provided. It will be shown that the detecting devices 360 may actuate and respond irrespective of line polarity and irrespective of the fact that other devices may have already initiated an alarm and that visual and/or audible signals may already be activated and/or selective auxiliary equipment controlled.

The smoke detector 360 illustrated in FIG. 3 may comprise a smoke detector similar to the type more fully disclosed in U.S. patent application Ser. No. 233,539 filed Feb. 11, 1981 by John J. Dobrzanski and entitled "Electrical Controls for Ionization Smoke Detector" and assigned to the same assignee as the present invention. It should also be understood that the device 360 may also comprise any of a wide variety of other devices which are characterized by including a diode bridge D361 connected to the lines 101 and 102 and including a detector, or signaling, device 364 in such manner that the device is not influenced by line polarity. Typically, the device 360 will draw a very small current from the cable pair 101 and 102 during the standby or inoperative position. This stand-by current may be of the order of 50 microamperes per device. The number of devices 360 which may be used on the line pair 101, 102 is limited by the sum of their standby current which must be sufficiently below the current through the end-of-line resistor 380 that the supervisory circuit including, voltage comparator VC1, is able to respond if the end-of-line resistor becomes disconnected. In response to activation of a device 360, the current will rise to a value of approximately 50 milliamperes.

The actual detector or signaling device 364 is not indicated in specific detail and is indicated generally as 364. In response to actuation of the device 364, the negative lead 363 from the diode bridge D361 will be coupled to the lead 365. It will be seen that lead 365 connects to one side of an associated relay K366 and that the other side of relay K366 is coupled to the positive output terminal 368 of the diode bridge D361. Accordingly, in response to the actuation of the detector or signaling device 364, the relay K366 may be actuated and the line current, attributable to the device 360, in the lines 101 and 102 is increased from approximately 50 microamperes to 50 milliamperes. The contacts K366A of the relay K366 may be used to control auxiliary apparatus similar to that which may have been controlled by relay K231.

It will be seen that each of the devices K231 which may be bridged across the line pair 101 and 102 will be actuated in response to the application of reverse potential on the lines 101 and 102. However, the relay K366 associated with each of the devices 360 will not be actuated until such time as the detector, or signaling element 364 associated therewith, is actuated. Accordingly, the devices 360 are fully operative with either potential applied to the cable pair 101 and 102 and may be used to alter the local conditions in response to the changing conditions in the various areas of the zone 200 or 300 protected and supervised by the cable pair 101 and 102.

If one of the devices 360 should be the first to respond to an abnormal condition or be used to transmit an alarm condition to the control station 100, the line current will increase from approximately from the 12 milliamperes drawn by the end-of-line resistor 380 to a magnitude of the order of 62 milliamperes. This will increase the potential at point 103 and cause the voltage comparator VC2 to respond in a manner previously described to turn on transistor T1 and actuate relay K12 which will lock itself in through contacts K12B and actuate relay K13 with contacts K12A. The actuation of relay K13 will reverse the potential applied to lines 101 and 102 as aforedescribed and with all the results previously described. However, it should be understood that any number of other devices 360 may be bridged across the cable pair 101 and 102 and that their respective detectors 364 may continue to monitor and respond to abnormal conditions and if such conditions are detected, the associated relay K366 may be actuated to provide any expedient control.

While there has been shown and described what is considered at present to be the preferred embodiment of the invention, modifications thereto will readily occur to those skilled in the related arts. For example, additional devices may be used on the cable pair and/or arranged in a different sequence. Also, a plurality of zones may be connected to a single control station. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described and it is intended to cover in the appended claims all such modifications as fall within the true spirit and scope of the invention.

What is claimed is:

1. A single zone alarm system comprising in cooperative combination:

(a) a control station;

(b) a cable pair coupled to said control station and extending therefrom to a supervised zone;

(c) a DC power supply at said control station coupled to said cable pair with a predetermined polarity;

(d) trouble condition identifying means at said control station coupled to said cable pair for supervising the magnitude of current in said cable pair and indicating a troubled condition when the current in said cable pair falls below a first predetermined value;

(e) alarm condition indicating means at said control station coupled to said cable pair for supervising the magnitude of current in said cable pair and indicating an alarm condition when the current in said cable pair rises above a second predetermined value which is greater than said first predetermined value;

(f) said alarm condition reverses the polarity of potential applied to said cable pair;

(g) one or more polarity sensitive alarm indicating devices bridged across said cable pair in said supervised zone for responding to said reverse polarity to provide audio/visual signals and/or activate associated devices; and (h) one or more polarity insensitive alarm initiating devices bridged across said cable pair in said supervised zone for responding to predetermined abnormal conditions by reducing the impedance of said polarity insensitive alarm initiating device from a high to an intermediate value whereby to increase the line current in said cable pair above said second predetermined value.

2. The combination claimed in claim 1 wherein one of said alarm indicating devices is coupled to one of said alarm initiating devices, so that said alarm indicating device will only respond when its associated alarm initiating device detects a predetermined abnormal condition.

3. The combination as set forth in claim 1 further including one or more polarity sensitive alarm initiating devices bridged across said cable pair for responding to a predetermined abnormal condition by placing a polarized electrical short circuit across said cable pair for responding to a predetermined abnormal condition by placing a polarized electrical short circuit across said cable which causes the line current to increase above said second predetermined value causing line reversal to occur and said alarm indicating devices to operate.

4. The combination as set forth in claim 1 wherein said control station includes current limiting means for limiting the total current drawn from said power supply by the devices bridged across said cable pair.

5. The combination as claimed in claim 1 wherein one or more of said polarity sensitive alarm indicating devices are one or more audible indicating devices.

6. The combination as claimed in claim 1 wherein one or more of said polarity sensitive alarm indicating devices are one or more visible alarm indicating devices.

7. The combination as claimed in claim 1 wherein said associated devices are one or more auxiliary relays.

8. The combination as claimed in claim 1 wherein one or more of said polarity insensitive alarm initiating devices are one or more smoke detectors.

9. The combination as set forth in claim 3 wherein one or more of said polarity sensitive alarm initiating devices are one or more fire alarm pull stations.

10. The combination as set forth in claim 3 wherein one or more of said polarity sensitive alarm initiating devices are one or more heat detectors.

11. The combination as set forth in claim 3 wherein one or more of said polarity sensitive alarm initiating devices are one or more contact closures.

* * * * *